US006134990A

United States Patent [19]

Ling et al.

[11] Patent Number: 6,134,990

[45] Date of Patent: Oct. 24, 2000

[54] RATCHETING TOOL WITH IMPROVED GEAR WHEEL/PAWL ENGAGEMENT

[75] Inventors: David Ling; Hsien-Chung Tuan-Mu, both of Taichung, Taiwan

[73] Assignee: Hand Tool Design Corporation, Wilmington, Del.

[21] Appl. No.: 09/368,963

[22] Filed: Aug. 5, 1999

[51] Int. Cl.[7] ..... B25B 13/46

[52] U.S. Cl. ..... 81/60; 81/63.2

[58] Field of Search ..... 81/60, 61, 62, 81/63, 63.1, 63.2, 121.1, 124.3

[56] References Cited

U.S. PATENT DOCUMENTS

| | | | |
|---|---|---|---|
| 3,838,614 | 10/1974 | O'Donnell . | |
| 4,991,468 | 2/1991 | Lee . | |
| 5,499,560 | 3/1996 | Aeschliman | 81/63.2 |
| 5,557,994 | 9/1996 | Nakayama | 81/478 |
| 5,626,062 | 5/1997 | Colvin | 81/63.2 |
| 5,636,557 | 6/1997 | Ma . | |
| 5,857,390 | 1/1999 | Whiteford | 81/62 |
| 5,873,286 | 2/1999 | Van Lenten | 81/575 |
| 5,913,954 | 6/1999 | Arnold et al. | 81/63.2 |
| 5,946,987 | 9/1999 | Wei | 81/63.2 |
| 5,979,274 | 11/1999 | Hsieh | 81/60 |

*Primary Examiner*—Timothy V. Eley
*Assistant Examiner*—Dung Van Nguyen
*Attorney, Agent, or Firm*—Alan Kamrath Oppenheimer Wolff & Donnelly LLP

[57] ABSTRACT

A ratcheting tool includes a handle and a box end extending from the handle. The box end has a first compartment and a second compartment communicating with the first compartment, a wall defining the second compartment having a cavity. A gear wheel is rotatably mounted in the first compartment and includes an inner periphery for engaging with a fastener and an outer periphery with a number of first teeth. A pawl is mounted in the second compartment and includes a first side with a number of second teeth facing the first teeth of the gear wheel and a second side facing away from the gear wheel. The second side of the pawl includes an eccentrically located groove with a rectilinear section that is at an angle with a longitudinal direction of the handle. A ball is partially received in the cavity and contacts with the groove of the second side of the pawl. An elastic member is mounted in the cavity for biasing the ball toward the groove of the second side of the pawl. The pawl is moved toward the gear wheel to cause the second teeth of the pawl to securely mesh with the first teeth of the gear wheel. The pawl is also moved to bear against a wall defining the second compartment.

11 Claims, 13 Drawing Sheets

RATCHETING TOOL WITH IMPROVED GEAR WHEEL/PAWL ENGAGEMENT

BACKGROUND OF THE INVENTION

1. Field of the Invention

The present invention relates to an improved gear wheel/pawl engagement for a ratcheting tool, e.g., a ring spanner or a combination wrench having a box end.

2. Description of the Related Art

U.S. Pat. No. 3,838,614 to O'Donnell issued on Oct. 1, 1974 discloses a ratcheting tool including a ratchet gear 26 mounted in a box end of a tool handle 1. A compression spring 20 is mounted in an elongated compartment 12 in the web area for biasing a double tooth dog 22 to engage with the ratchet gear 26. The elongated compartment 12 is slanted to provide improved engaging effect between the double tooth dog and the ratchet gear. Yet, manufacture of this slanted, elongated compartment 12 is relatively difficult, and an additional ratchet cover 14 that adversely affects the aesthetically pleasing effect is required.

U.S. Pat. No. 4,991,468 to Lee issued on Feb. 12, 1991 discloses a wrench body including a driver wheel 17 mounted in a head 10 thereof. A spring 18 is mounted in lateral hole 102 in the head 10 for biasing a pawl 40 to engage with the ratchet gear 26. A tiny plate 19 is provided to seal the hole 102 and to which an end of the spring 18 is attached. Nevertheless, it is difficult to control the position of the tiny plate 19 that affects the biasing force of the spring 18. In some cases, the driver wheel 17 is stuck.

U.S. Pat. No. 5,636,557 to Ma issued on Jun. 10, 1997 discloses a ratchet type ring spanner including a ratchet wheel 20 mounted in a box end of a ring spanner. A spring 16 is mounted in a slanted manner for urging an arcuate toothed member 14 to engage with the ratchet wheel 20. A stop member 15 is utilized to provide a support for positioning the spring 16. Thus, there is no need to drill a hole in the web area of the ring spanner for installing the spring. Nevertheless, the stop member 15 results in a difficult assembly procedure. In addition, the arcuate toothed member 14 has a long travel and thus tends to be stuck and requires a larger head for receiving the arcuate toothed member 14.

FIG. 9 of the drawings illustrates a ratcheting tool including a ratchet wheel 1' mounted in a box end thereof. A spring 3' is mounted in a cavity 4' in the web area of the tool for urging a pawl 2' to engage with the ratchet wheel 1'. Nevertheless, installation of and positioning for the spring 3' are big problems such that the spring 3' tends to disengage from the pawl 2'. The pawl 2' has a long travel and thus tends to be stuck during its return travel.

FIG. 10 of the drawings illustrates a ratcheting tool 11' with a ratchet wheel 7' mounted in a head thereof for engaging with a socket 8'. A hole 9' is defined in the ratchet wheel 7' for receiving a positioning member 5' with a dome head. A spring 6' is mounted in the hole 9' for biasing the dome head of the positioning member 5' outward to engage with one of a number of arcuate recesses 10' in an outer periphery of the socket 8'. It is, however, found that the ratchet wrench includes too many components and thus is troublesome to assemble. In addition, the driving torque of this ratchet wrench is relatively low, as the positioning effect between the dome head of the positioning member 5' and the arcuate recess 10' is poor.

FIGS. 11 and 12 of the drawings illustrate a ratcheting tool 12' including a number of teeth 13' in an inner periphery of a box end thereof. A ratchet wheel 14' is mounted in the box end of the ratcheting tool 12' and includes a number of annularly spaced grooves 15' in an outer periphery thereof. A positioning member 16' is secured in each groove 15' and located between the teeth 13' in the box end and the ratchet wheel 14', thereby providing an engaging effect. Nevertheless, the positioning member 16' is too small and thus provides poor driving torque. In addition, assembly for this ratchet wheel is troublesome, as it has too many components.

FIG. 13 of the drawings illustrates a ratcheting tool 17' including a ratchet wheel 18' mounted in a box end thereof. A pawl 19' is mounted in a cavity 21' in a web area of the tool 17' and biased by a spring 20' to engage with the ratchet wheel 18'. The pawl 19' includes a notch 22' for receiving an end of the spring 20'. Nevertheless, it is not easy to secure the spring 20' in the cavity 21'. As a result, the spring 20' tends to disengage from the pawl 19' and thus adversely affects the ratcheting function. The driving torque provided by the ratcheting tool is accordingly low. In addition, the spring merely provides a radial force for biasing the pawl 19' to engage with the ratchet wheel 18', yet no horizontal force is imparted to the pawl 19' and thus fails to provide the function of ratcheting in a single direction.

FIGS. 14 and 15 of the drawings illustrate a reversible ring spanner including a ratchet wheel 24' mounted in a box end 23' thereof. A spring 27' is mounted in a cavity 26' in a web area of the ring spanner for biasing a pawl 25' to engage with the ratchet wheel 24'. It is found that the pawl 25' with a single tooth is not capable of providing the required retaining effect. The ratchet wheel tends to be stuck. The driving torque of the spanner is poor.

In conclusion, the above-mentioned conventional ratcheting tools fail to provide high torque operation, as the pawl merely engages with the ratchet wheel by at best three teeth. If the teeth number of the pawl is increased, the head of the ratcheting tool has to be enlarged to accommodate the pawl and thus is difficult to be used in a limited space. In addition, free rotation of the ratcheting tool during ratcheting is too large (larger than the theoretic value of 5°), due to the long travel of the pawl.

The present invention is intended to provide an improved gear wheel/pawl engagement for a ratcheting tool that mitigates and/or obviates the above problems.

SUMMARY OF THE INVENTION

It is a primary object of the present invention to provide a ratcheting tool with an improved gear wheel/pawl engagement to provide improved driving torque. The pawl engages with the gear wheel by at least twelve teeth and thus may bear a higher torque during ratcheting.

In accordance with the present invention, a ratcheting tool comprises:

- a handle;
- a box end extended from the handle and having a first compartment and a second compartment communicating with the first compartment;
- a gear wheel rotatably mounted in the first compartment and including an inner periphery adapted to be engaged with a fastener and an outer periphery with a plurality of first teeth;
- a pawl mounted in the second compartment and including a first side with a plurality of second teeth facing the first teeth of the gear wheel and a second side facing away from the gear wheel, the second side of the pawl including an operative section that is at an angle with a longitudinal direction of the handle; and a biasing means mounted in the second compartment and in operative contact with the operative section of the second side of the pawl for biasing the pawl toward the gear wheel such that the second teeth of the pawl securely mesh with the first teeth of the gear wheel and for biasing the pawl to bear against a wall defining the second compartment.

The wall defining the second compartment includes a cavity for receiving the biasing means. The biasing means includes a ball partially received in the cavity and an elastic member mounted in the cavity for biasing the ball to exert a force on the operative section. The operative section is preferably rectilinear. Preferably, the second side of the pawl includes an eccentrically located groove with a rectilinear section.

In a preferred embodiment of the invention, a ratcheting tool comprising:

a handle;

a box end extended from the handle and having a first compartment and a second compartment communicating with the first compartment, a wall defining the second compartment having a cavity;

a gear wheel rotatably mounted in the first compartment and including an inner periphery adapted to be engaged with a fastener and an outer periphery with a plurality of first teeth;

a pawl mounted in the second compartment and including a first side with a plurality of second teeth facing the first teeth of the gear wheel and a second side facing away from the gear wheel, the second side of the pawl including an eccentrically located groove with a rectilinear section that is at an angle with a longitudinal direction of the handle;

a ball partially received in the cavity and in operative contact with the groove of the second side of the pawl; and an elastic member mounted in the cavity for biasing the ball toward the groove of the second side of the pawl such that the pawl is moved toward the gear wheel to cause the second teeth of the pawl to securely mesh with the first teeth of the gear wheel and that the pawl is also moved to bear against a wall defining the second compartment.

The ratcheting tool in accordance with the present invention may bear much higher torque and has a minimum free rotating angle that is very useful when operating in a limited space.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
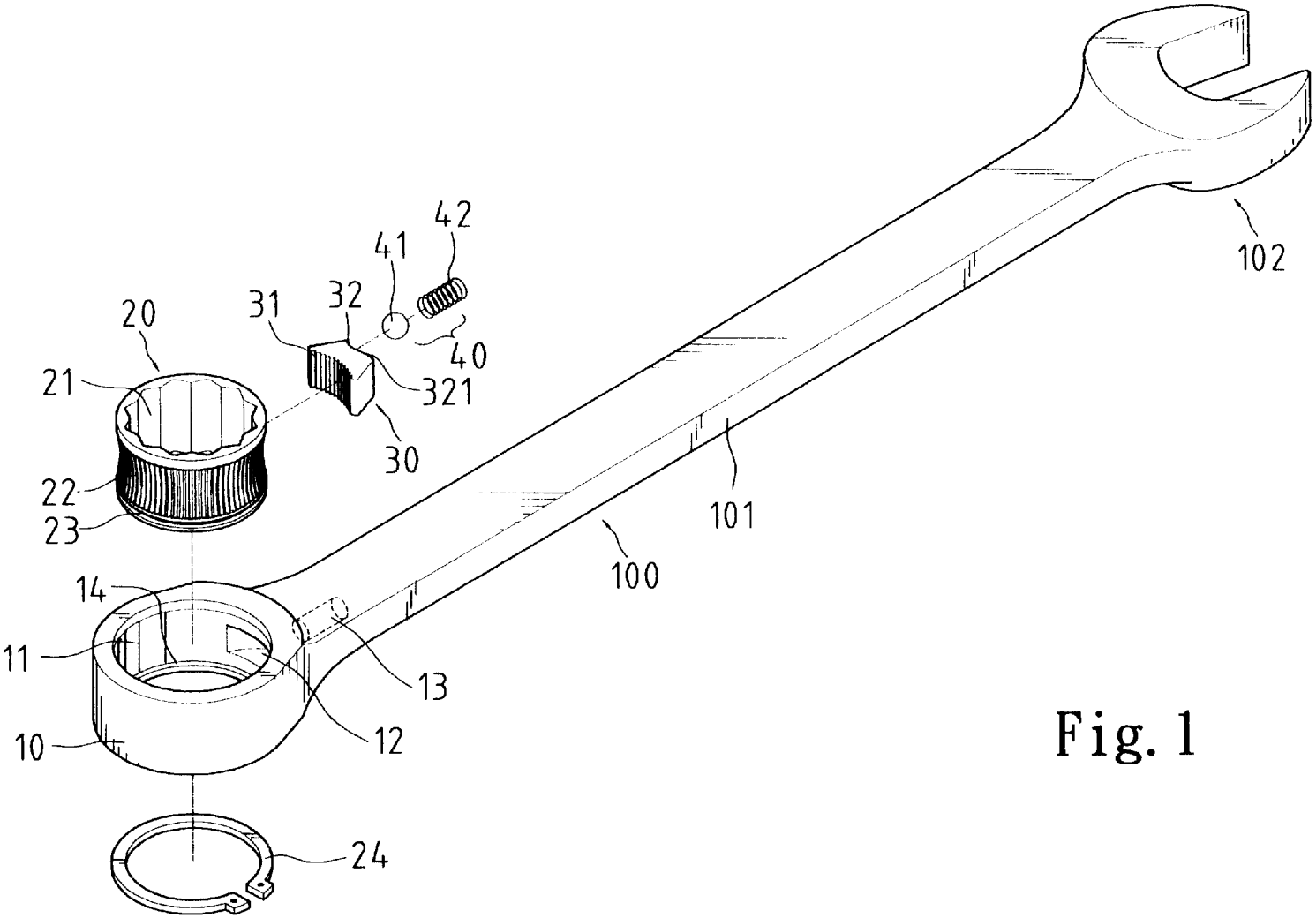
FIG. 1 is a perspective view, partly exploded, of a ratcheting tool in accordance with the present invention.
Figure 2:
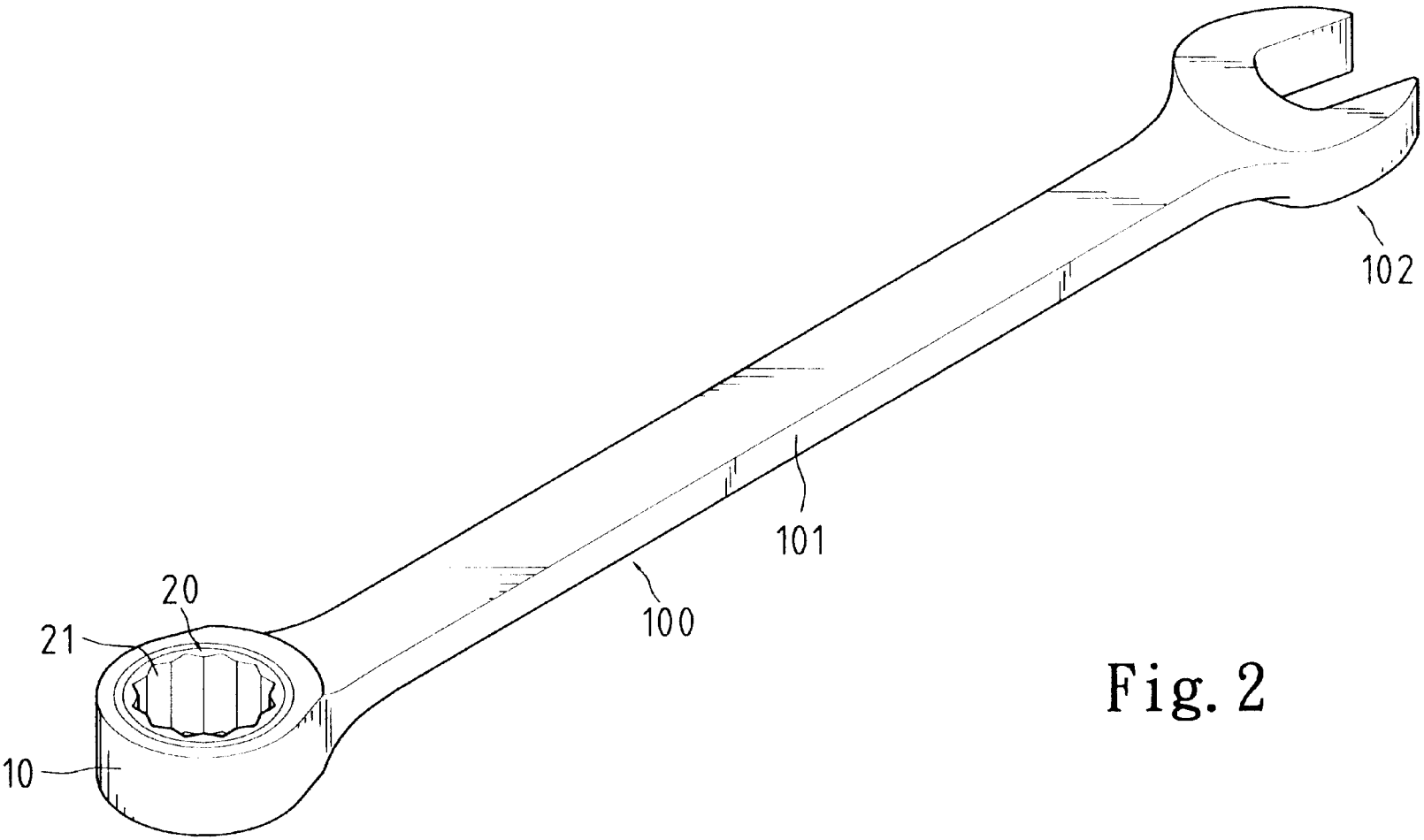
FIG. 2 is a perspective view of the ratcheting tool in accordance with the present invention.

Referring to FIGS. 1 through 8 and initially to FIGS. 1 and 2, a ratcheting tool in accordance with the present invention is in the form of a combination wrench 100 having a handle 101, a box end 10, and an open end 102. The box end 10 includes a first compartment 11. A web area (not labeled) between the handle 101 and the box end 10 includes a second compartment 12 that communicates with the first compartment 11. A wall that defines the second compartment 12 includes a cavity 13. The box end 10 further includes an annular ledge 14 in a lower end thereof.

A gear wheel 20 is rotatably mounted in the first compartment 11 and rests on the annular ledge 14. The gear wheel 20 includes an inner periphery 21 for engaging with a fastener to be tightened or loosened and a plurality of teeth 22 in an outer periphery thereof. An annular groove 23 is defined in a lower end of the outer periphery of the gear wheel 20 for receiving a C-clip 24, thereby retaining the gear wheel 20 in the first compartment 11.

A pawl 30 is mounted in the second compartment 12 and includes an arcuate first side facing the gear wheel teeth 22. The arcuate first side has a plurality of teeth 31. The pawl 30 further includes a second side facing away from the gear wheel teeth 22. The second side includes an eccentrically located groove 32 with a rectilinear section 321 that is proximal to a longitudinal axis thereof and that is at an angle with a longitudinal direction of the handle 101.

A biasing means 40 is mounted in the cavity 13. In this embodiment, the biasing means 40 includes a ball 41 engaged with a wall defining the groove 32 and an elastic member 42 for biasing the ball 41 to engage with the wall defining the groove 32.

Figure 3:
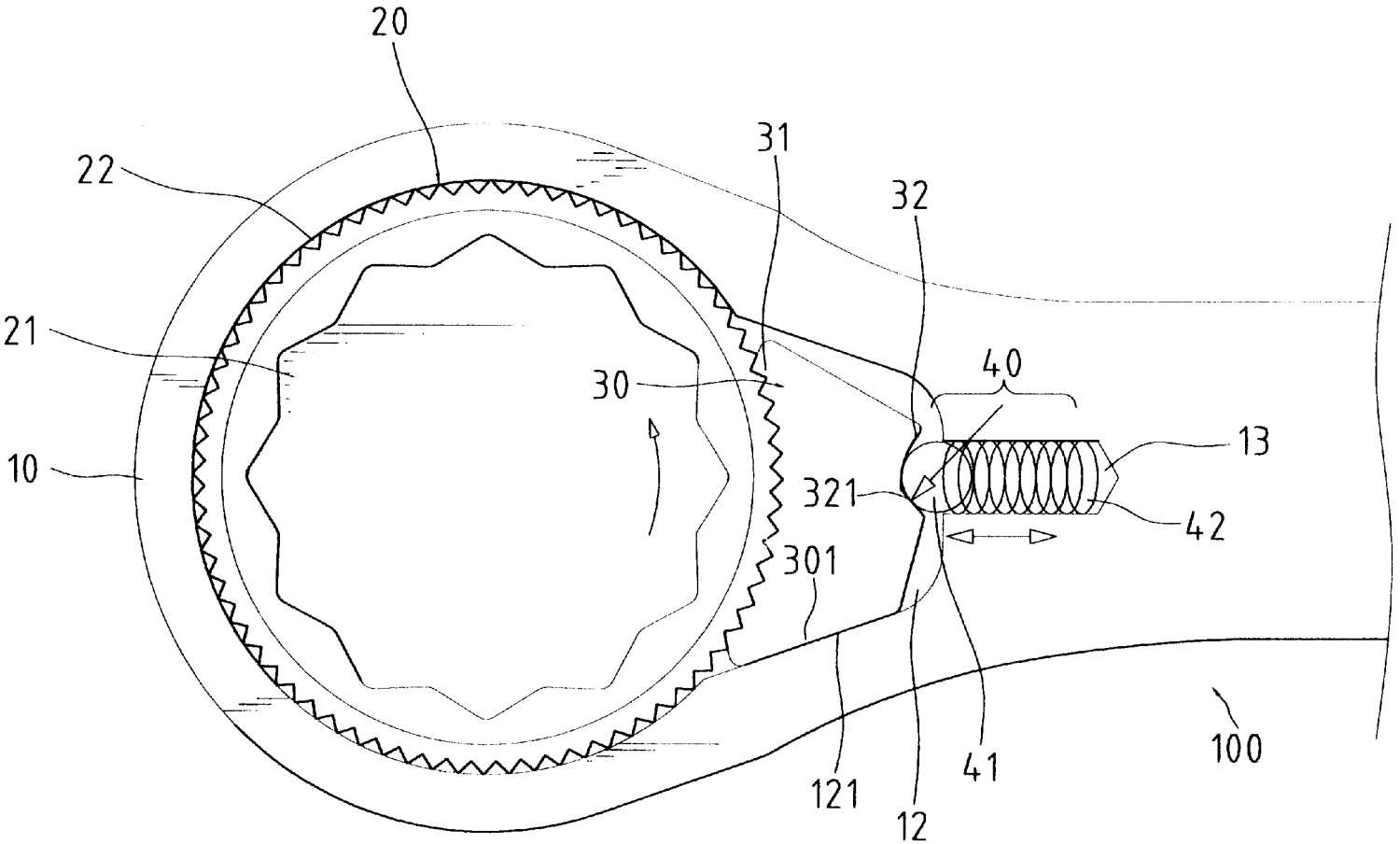
FIG. 3 is a sectional view, in an enlarged scale, of an end portion of the ratcheting tool in accordance with the present invention.
Figure 4:
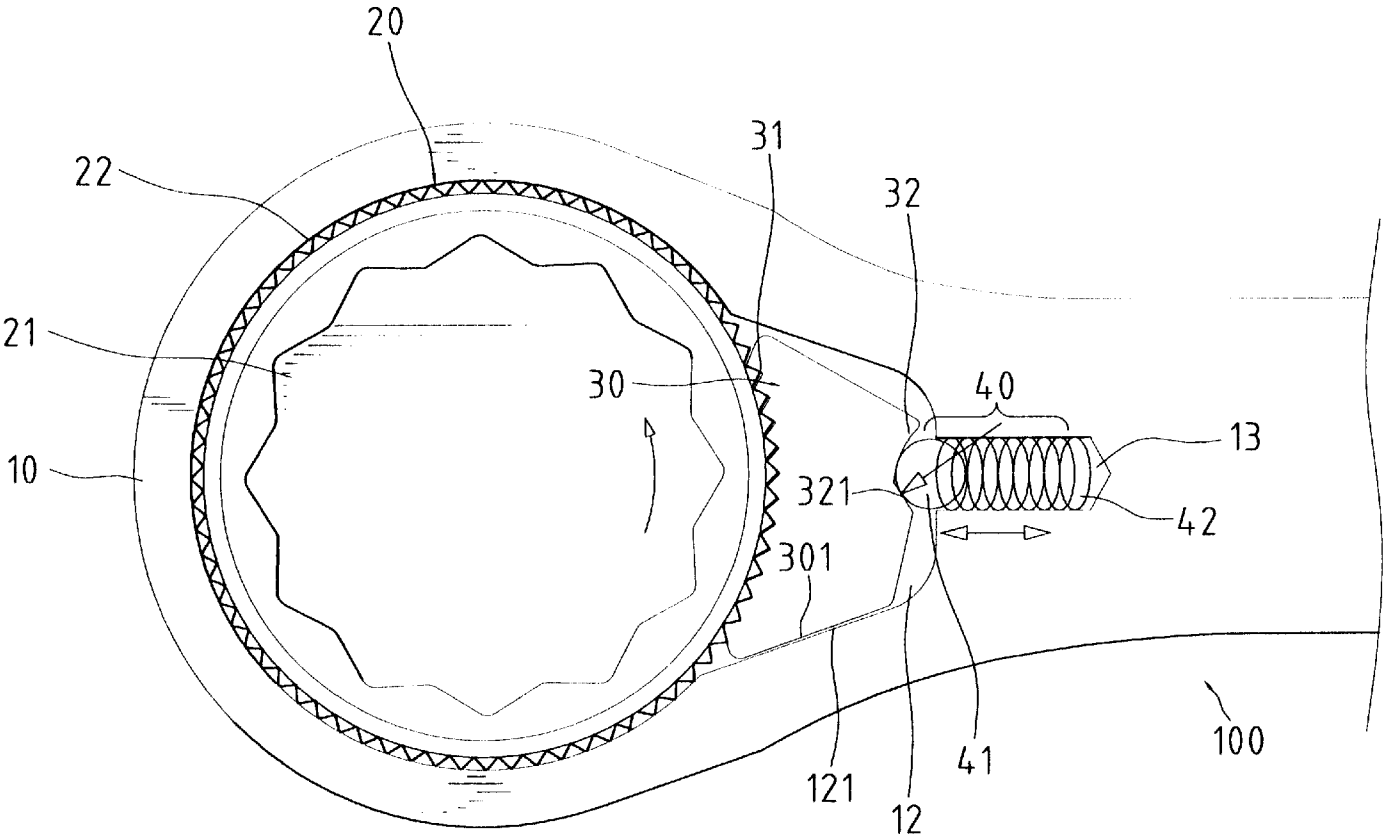
FIG. 4 is a sectional view similar to FIG. 3, wherein the gear wheel of the ratcheting tool is rotated through 1°.
Figure 5:
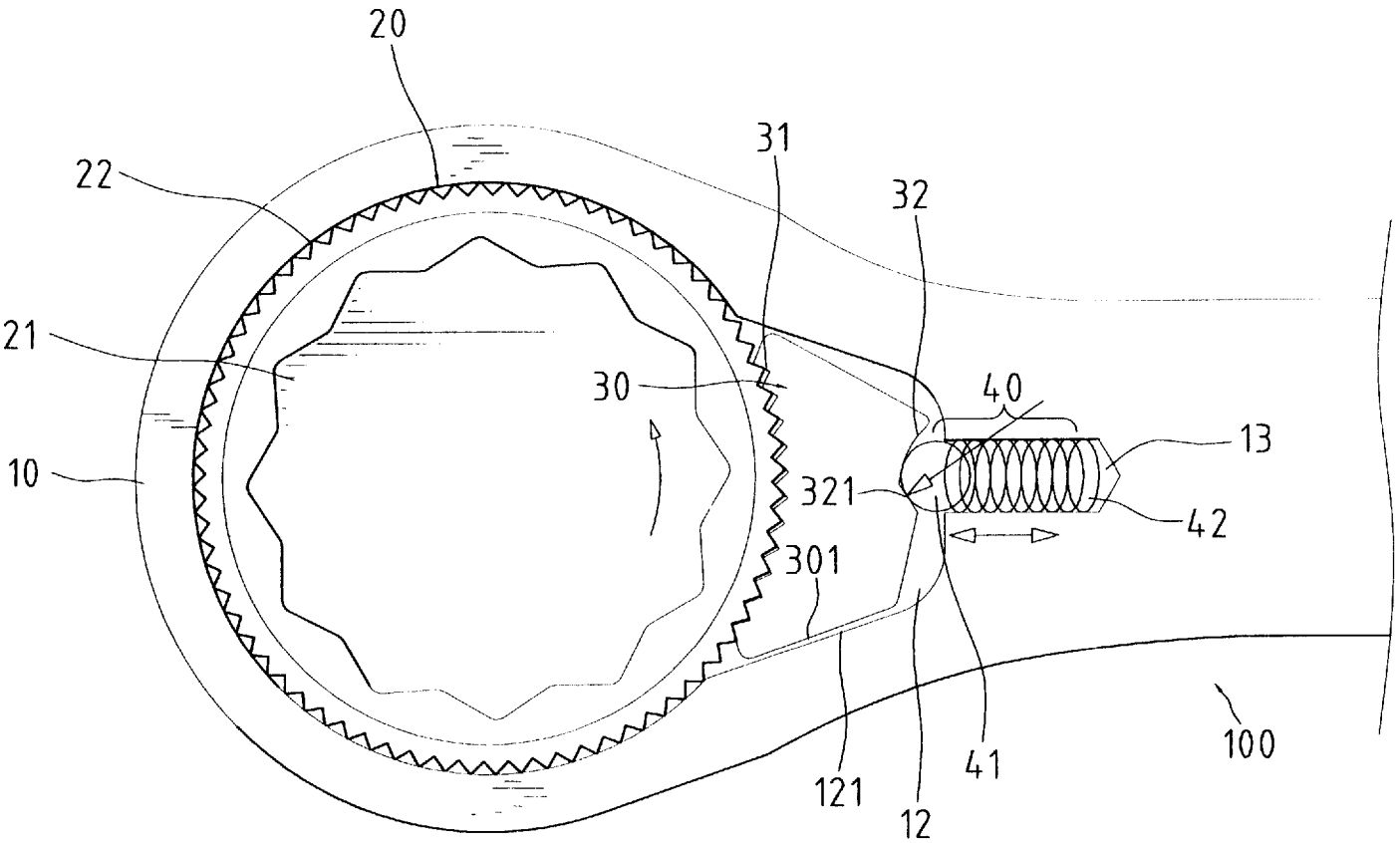
FIG. 5 is a sectional view similar to FIG. 3, wherein the gear wheel of the ratcheting tool is rotated through 2°.
Figure 6:
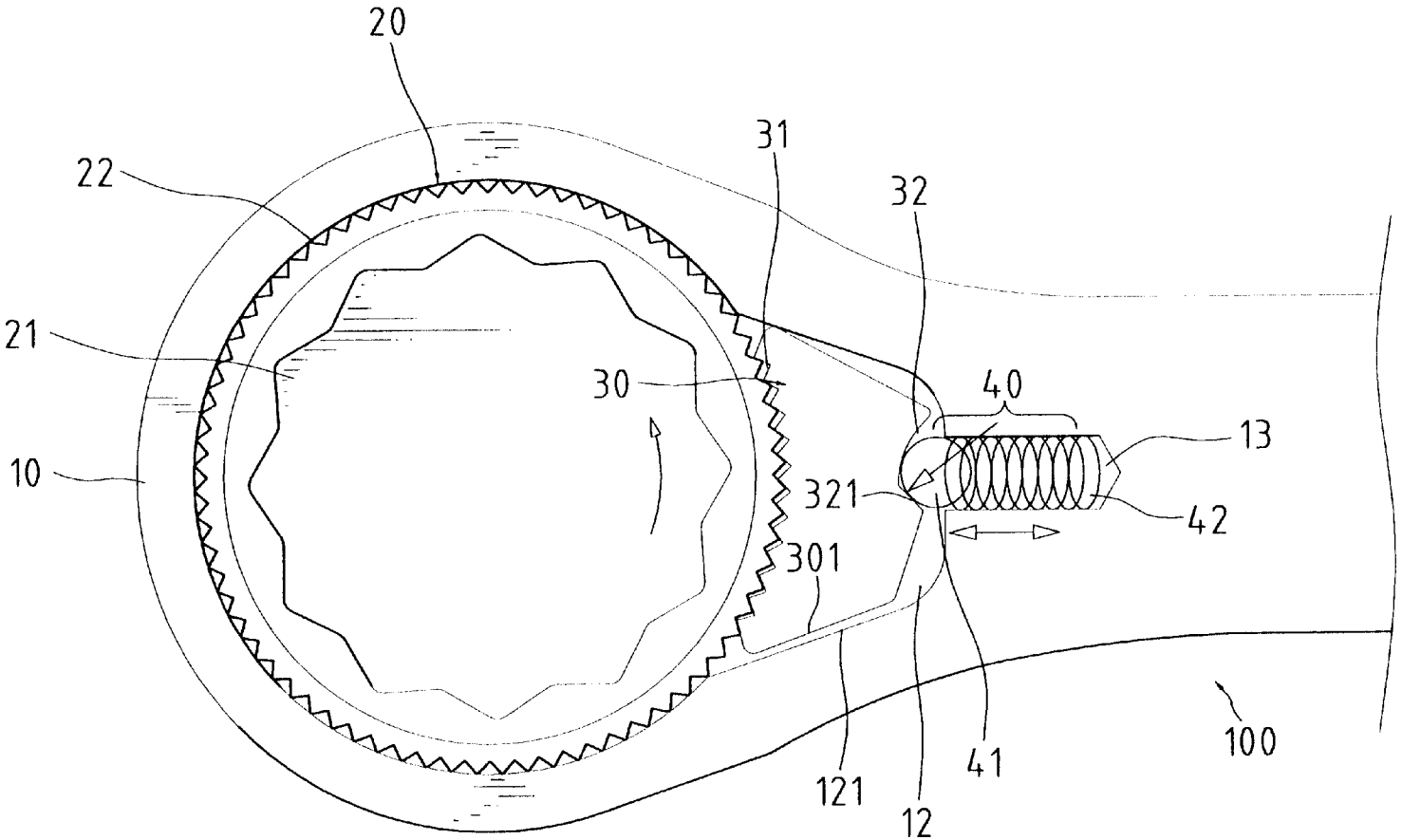
FIG. 6 is a sectional view similar to FIG. 3, wherein the gear wheel of the ratcheting tool is rotated through 3°.
Figure 7:
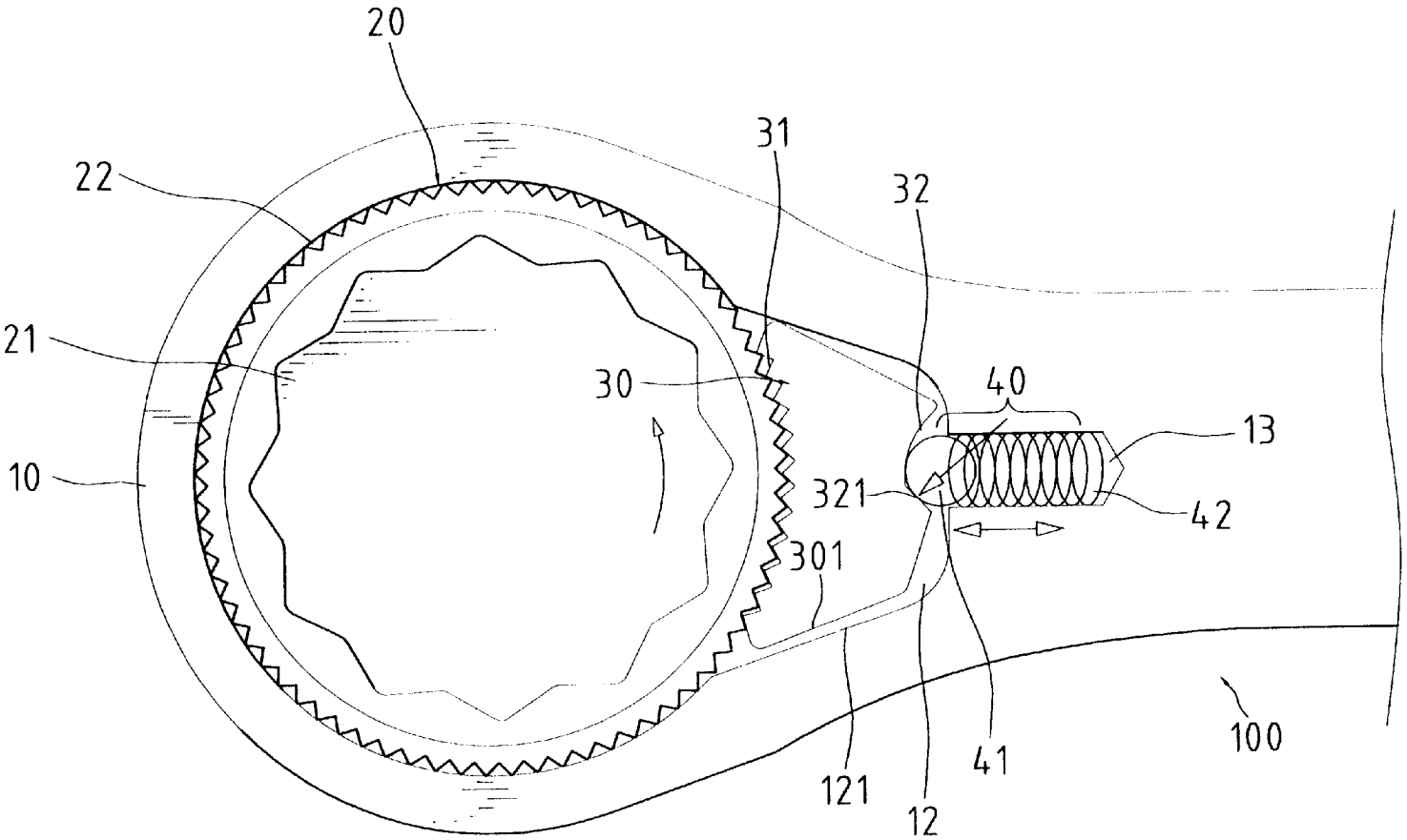
FIG. 7 is a sectional view similar to FIG. 3, wherein the gear wheel of the ratcheting tool is rotated through 4°.
Figure 8:
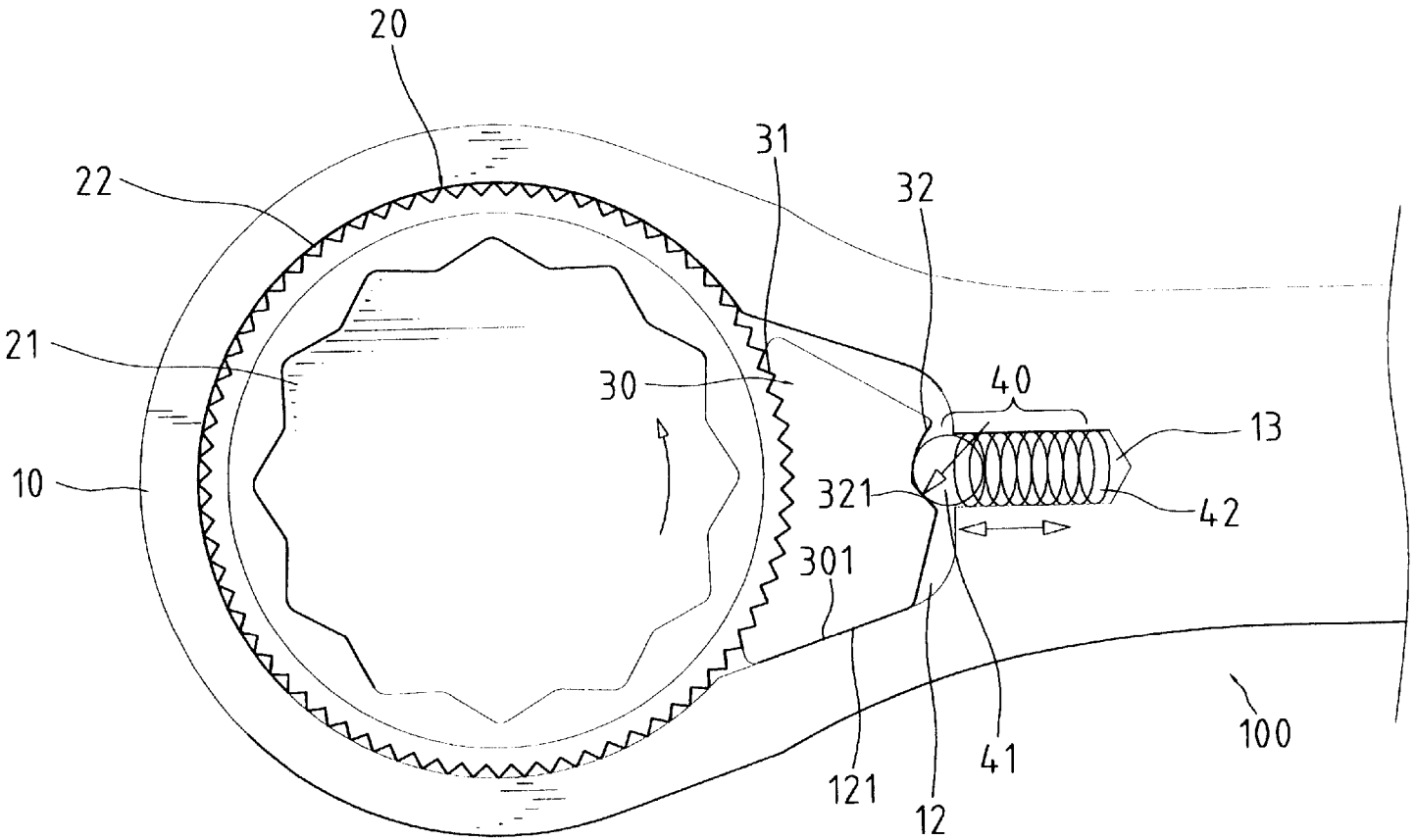
FIG. 8 is a sectional view similar to FIG. 3, wherein the gear wheel of the ratcheting tool is rotated through 5°.
Figure 9:
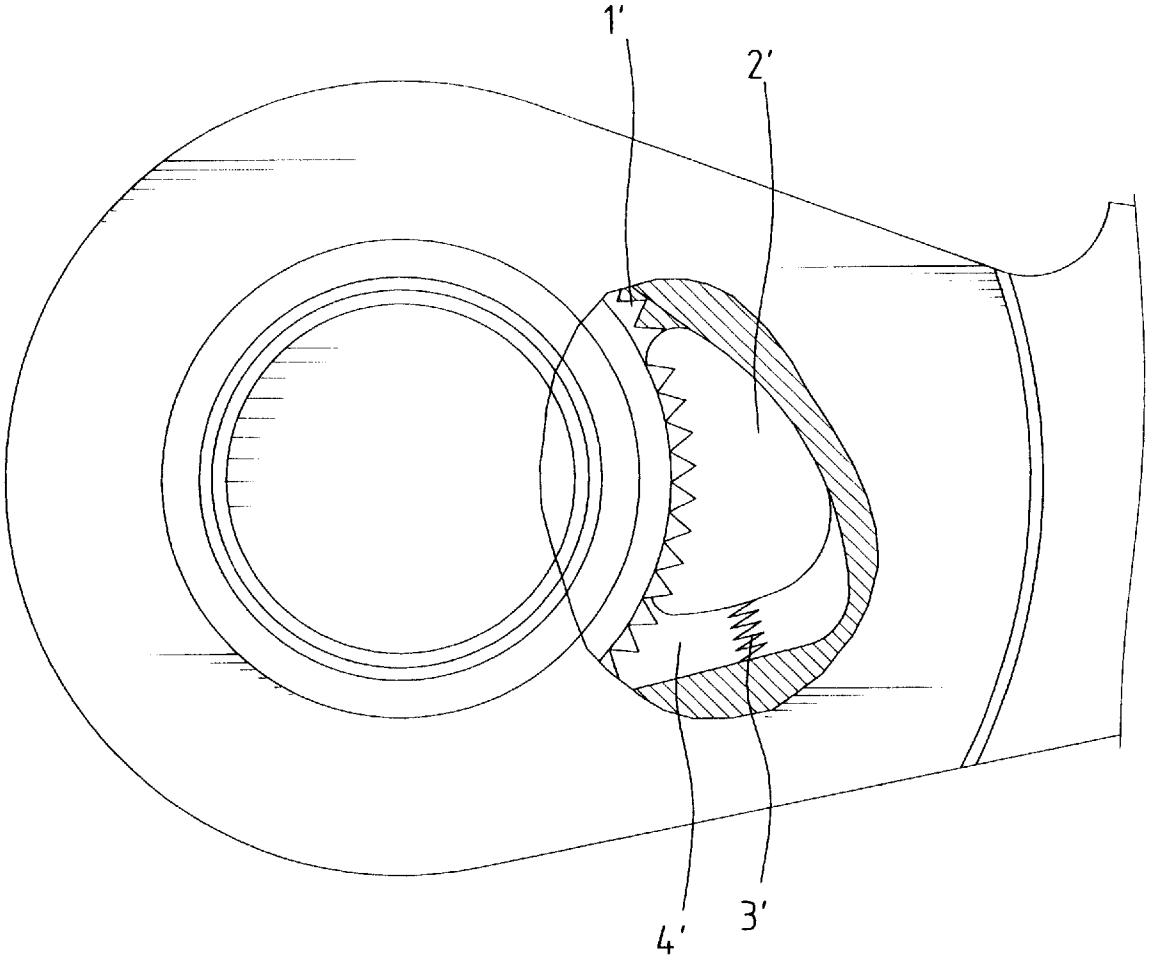
Fig. 9 PRIOR ART
FIG. 9 is a top view, partly sectioned, of a conventional ratcheting tool.
Figure 10:
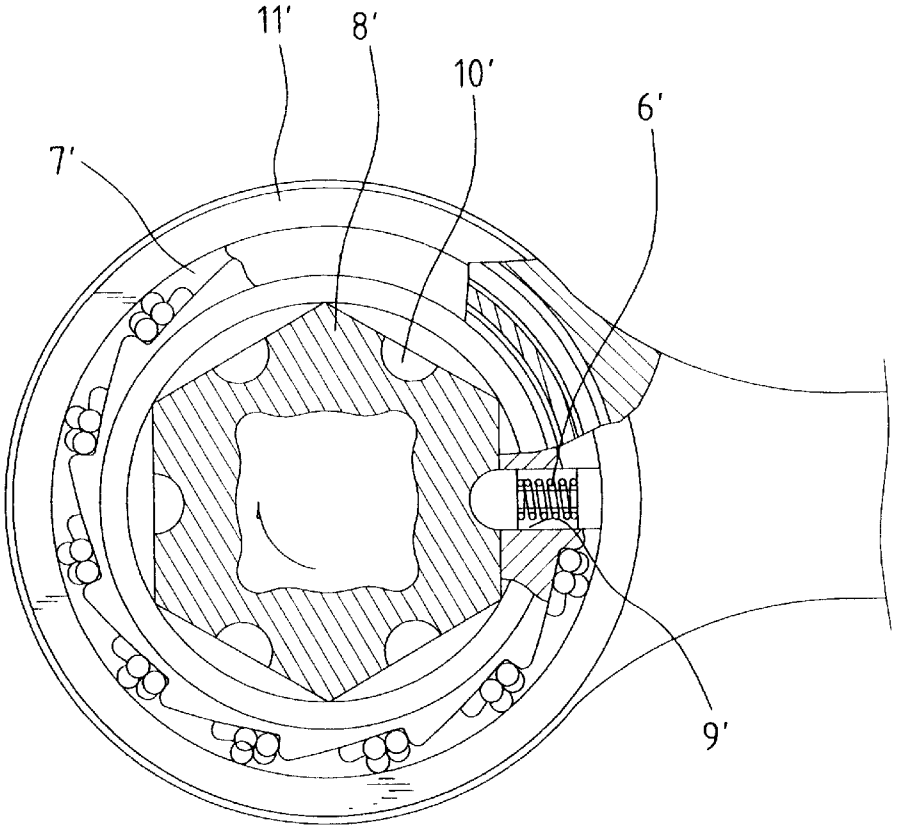
Fig. 10 PRIOR ART
FIG. 10 is a top view, partly sectioned, of another conventional ratcheting tool.
Figure 12:
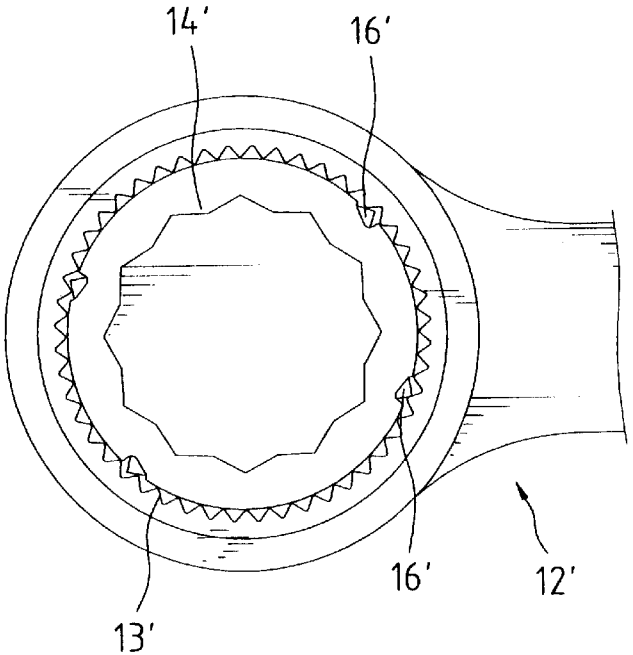
Fig. 12 PRIOR ART
FIG. 12 is a top view of the conventional ratcheting tool in FIG. 11.
Figure 11:
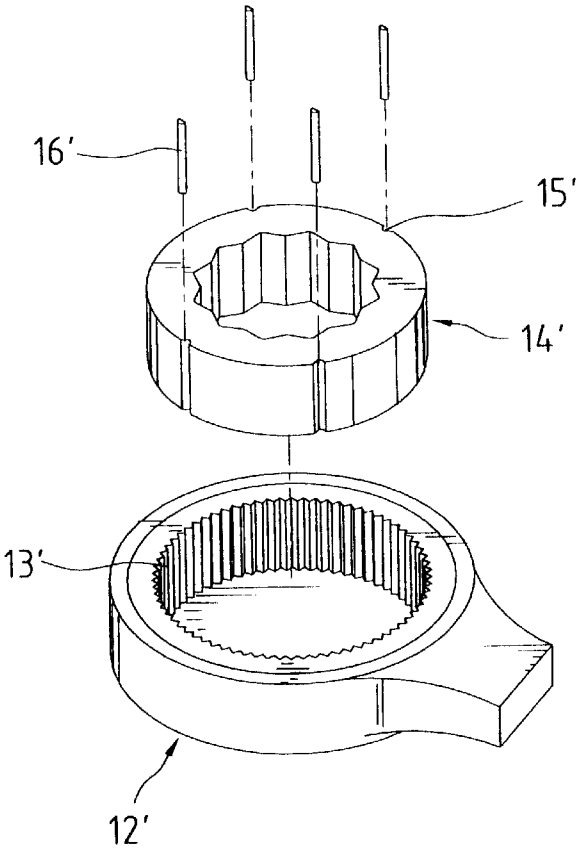
Fig. 11 PRIOR ART
FIG. 11 is an exploded perspective view of a further conventional ratcheting tool.
Figure 13:
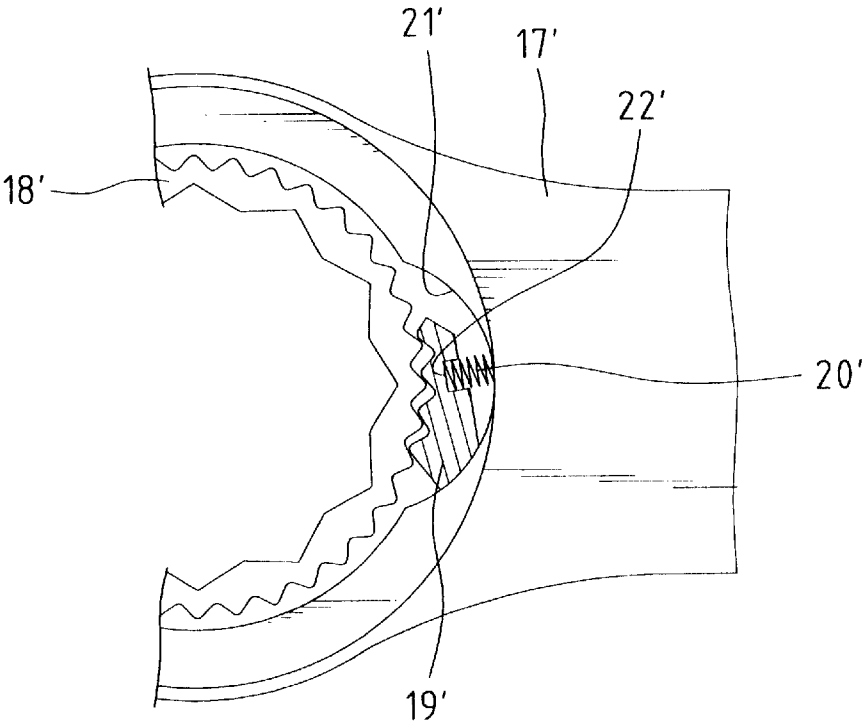
Fig. 13 PRIOR ART
FIG. 13 is a partial top view of still another conventional ratcheting tool.
Figure 14:
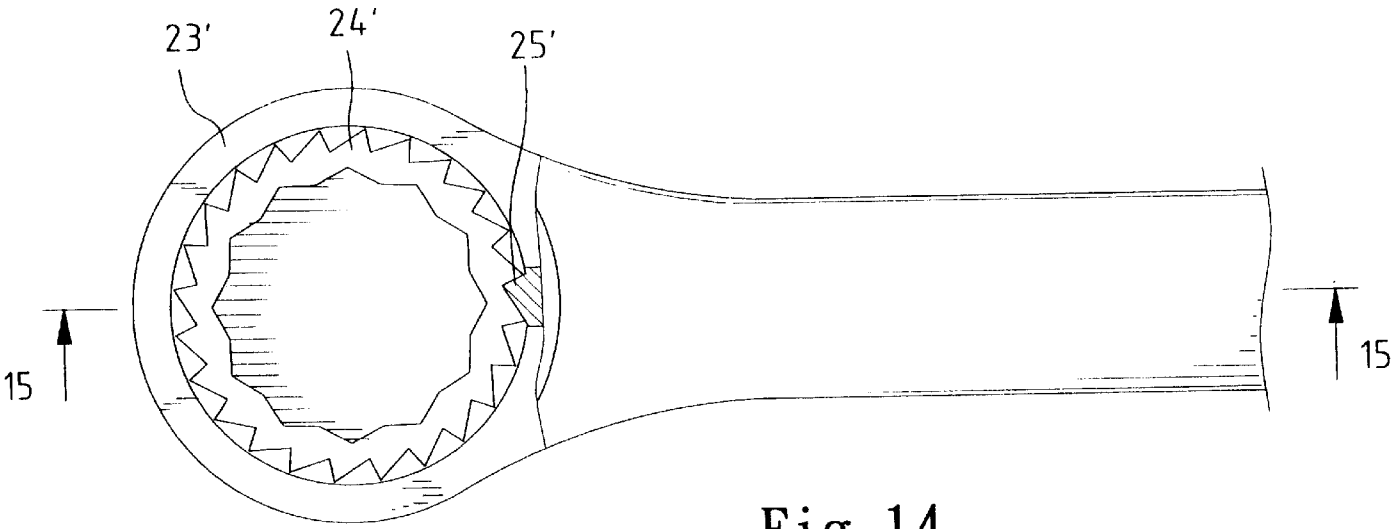
Fig. 14 PRIOR ART
FIG. 14 is a top view of a conventional reversible ring spanner.
Figure 15:
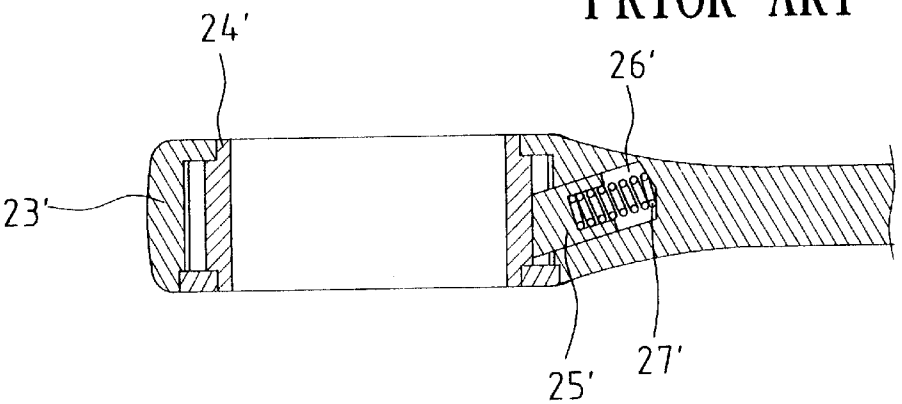
Fig. 15 PRIOR ART
FIG. 15 is a sectional view taken along line 15—15 in FIG. 14.

The ratcheting tool after assembly is shown in FIG. 3. It is appreciated that the pawl 30 engages with the gear wheel 20 by at least twelve (12) teeth and thus may bear higher torque during ratcheting. It is noted that the ball 41 exerts a force on the rectilinear section 321 of the second side of the pawl 30 under the action of the elastic member 42. As a result, the force is imparted into a radial (horizontal) force to urge the pawl 30 along the radial direction to securely engage with the teeth 22 of the gear wheel 20 and a downward force (as seen from FIG. 3) to urge a side 301 of the pawl 30 to bear against the wall 121 defining the second compartment 12. Thus, the torque acting on the pawl 30 during ratcheting is transmitted to the wall 121 defining the second compartment 12.

FIGS. 4 through 8 illustrate free rotation of the gear wheel 20. It is noted that the pawl 30 re-engages with the gear wheel teeth 22 after the gear wheel 20 is rotated through 5° (for a gear wheel with seventy-two (72) teeth). More specifically, the ratcheting tool has a minimum free rotating angle during ratcheting, which is impossible to be achieved by conventional ratcheting tools.

According to the above description, it is appreciated that the ratcheting tool in accordance with the present invention may bear much higher torque and has a minimum free rotating angle that is very useful when operating in a limited space.

Although the invention has been explained in relation to its preferred embodiment, it is to be understood that many other possible modifications and variations can be made without departing from the spirit and scope of the invention as hereinafter claimed.

What is claimed is:

1. A ratcheting tool comprising, in combination:

a handle;

a box end extending from the handle and having a first compartment and a second compartment communicating with the first compartment, with the first compartment having a cylindrical wall, with the second compartment having a linear wall extending at an obtuse angle to the cylindrical wall;

a gear wheel rotatably mounted in the first compartment and including an inner periphery adapted to be engaged with a fastener and an outer periphery with a plurality of first teeth;

a pawl mounted in the second compartment and being of a size smaller than the second compartment to allow movement of the pawl in the second compartment adjacent the outer periphery of the gear wheel, with the pawl including an arcuate first side with a plurality of second teeth facing the first teeth of the gear wheel, a second side facing away from the gear wheel, and a linear third side extending from the first side, with the second side of the pawl including an operative section that is at an angle with a longitudinal direction of the handle; and a biasing means mounted in the second compartment and in operative contact with the operative section of the second side of the pawl for biasing the pawl toward the gear wheel such that the second teeth of the pawl securely mesh with the first teeth of the gear wheel and for biasing the linear third side of the pawl to bear against the linear wall defining the second compartment during ratcheting and for allowing the linear third side of the pawl to be spaced from the linear wall defining the second compartment during free rotation of the gear wheel.

2. The ratcheting tool as claimed in claim 1, wherein the wall defining the second compartment includes a cavity for receiving the biasing means.

3. The ratcheting tool as claimed in claim 2, wherein the biasing means includes a ball partially received in the cavity and an elastic member mounted in the cavity for biasing the ball to exert a force on the operative section.

4. The ratcheting tool as claimed in claim 1, wherein the operative section is rectilinear.

5. The ratcheting tool as claimed in claim 1, wherein the second side of the pawl includes an eccentrically located groove with a rectilinear section.

6. A ratcheting tool comprising, in combination:

a handle;

a box end extending from the handle and having a first compartment and a second compartment communicating with the first compartment, a wall defining the second compartment having a cavity;

a gear wheel rotatably mounted in the first compartment and including an inner periphery adapted to be engaged with a fastener and an outer periphery with a plurality of first teeth;

a pawl mounted in the second compartment and including an arcuate first side with a plurality of second teeth facing the first teeth of the gear wheel and a second side facing away from the gear wheel, the second side of the pawl including an operative section that is at an angle with a longitudinal direction of the handle;

a ball partially received in the cavity and in operative contact with the operative section of the second side of the pawl; and an elastic member mounted in the cavity for biasing the ball toward the operative section of the second side of the pawl such that the pawl is moved toward the gear wheel to cause all of the second teeth of the pawl to simultaneously mesh with the first teeth of the gear wheel and that the pawl is also moved to bear against the wall defining the second compartment.

7. The ratcheting tool as claimed in claim 6, wherein the operative section is rectilinear.

8. The ratcheting tool as claimed in claim 7, wherein the operative section of the second side of the pawl includes an eccentrically located groove with a rectilinear section, and wherein the ball is partially extended into the groove under the action of the elastic member to bear against the rectilinear section of the groove, thereby urging the pawl to bear against the wall defining the second compartment, and wherein the ball also bears against a portion of the groove other than the rectilinear section to urge all of the second teeth of the pawl to mesh with the first teeth of the gear wheel.

9. The ratcheting tool as claimed in claim 6, wherein the arcuate first side and the plurality of second gear teeth are generally concentric to the outer periphery of the gear wheel.

10. The ratcheting tool as claimed in claim 9, wherein the plurality of second teeth includes at least 10 teeth.

11. The ratcheting tool as claimed in claim 10, wherein the plurality of second teeth includes 12 teeth.

* * * * *